US009410402B2

(12) United States Patent
Wang et al.

(10) Patent No.: US 9,410,402 B2
(45) Date of Patent: Aug. 9, 2016

(54) METHOD FOR SWEEPING SOLIDS OR DISPLACING A FLUID IN A WELLBORE

(71) Applicant: Sharp-Rock Technologies, Inc., Cypress, TX (US)

(72) Inventors: Hong Wang, Cypress, TX (US); Ling Wang, Suzhou (CN)

( * ) Notice: Subject to any disclaimer, the term of this patent is extended or adjusted under 35 U.S.C. 154(b) by 281 days.

(21) Appl. No.: 14/225,346

(22) Filed: Mar. 25, 2014

(65) Prior Publication Data

US 2015/0275600 A1 Oct. 1, 2015

(51) Int. Cl.
*E21B 21/06* (2006.01)
*E21B 37/00* (2006.01)

(52) U.S. Cl.
CPC ..... *E21B 37/00* (2013.01); *E21B 21/066* (2013.01)

(58) Field of Classification Search
CPC ..... E21B 37/00; E21B 37/02; E21B 37/06; E21B 37/10; E21B 31/03; E21B 21/066; H01F 1/42
USPC ..... 166/311; 175/209
See application file for complete search history.

(56) References Cited

U.S. PATENT DOCUMENTS 6,016,872 A 1/2000 Davis
6,164,380 A 12/2000 Davis
6,419,019 B1 7/2002 Palmer et al.
7,703,529 B2 * 4/2010 Robinson ..... C09K 8/536 166/305.1
7,741,247 B2 6/2010 Wang
8,109,331 B2 * 2/2012 Lynde ..... E21B 37/00 166/105.3
2005/0217854 A1 * 10/2005 Hayes ..... E21B 43/11 166/297
2009/0091053 A1 * 4/2009 Polizzotti ..... C08J 9/365 264/48
2010/0230164 A1 * 9/2010 Pomerleau ..... C09K 8/032 175/40
2013/0048285 A1 * 2/2013 Boulard ..... C09K 8/12 166/293
2013/0143777 A1 * 6/2013 Wang ..... E21B 33/138 507/204
2014/0262300 A1 * 9/2014 Ronner ..... E21B 37/00 166/312

* cited by examiner

*Primary Examiner* — Michael Wills, III
(74) *Attorney, Agent, or Firm* — David McEwing

(57) ABSTRACT

A method and system for removing solids or displacing a fluid from a wellbore wherein a plurality of resilient rubber-like flexible reticulated open cell foam elements are dispersed in a fluid and pumped through drill pipe and into the annulus between the wellbore and the drill pipe. In the annulus, the foam elements impact and dislodge solids such as proppants, gravels, drilled cuttings and other solids or a fluid to be displaced and the proppants, etc. or the fluid are carried by the fluid containing the foam elements back to the surface or a different location in the wellbore. At the surface, the fluid containing the foam elements and the proppants, etc., is carried to a shale shaker where the solids and the foam elements are separated from the fluid. The separated solids and foam are collected for disposal and, after adding new foam elements, the fluid can be recirculated down hole.

20 Claims, 2 Drawing Sheets

METHOD FOR SWEEPING SOLIDS OR DISPLACING A FLUID IN A WELLBORE

1. FIELD OF THE INVENTION

This invention relates generally to methods for removing solids and debris from a wellbore including the bottom of the wellbore and, more particularly, to a method utilizing a suspension comprising a plurality of rubber-like flexible reticulated open cell foam elements mixed in fluid for removing or sweeping proppants, gravels, drilled cuttings, formation cavings, casing milling debris, and other wellbore debris from one location in a wellbore and transporting them to the surface or another location such as a fracture in the wellbore. It also relates to displacing one type of fluid with another type.

2. BACKGROUND ART

During drilling a hydrocarbon well, drilled cuttings are generated. Formation cavings from an unstable wellbore are also often produced when the wellbore is created. On some occasions, junk may fall into a wellbore and may have to be cleaned out or removed before further normal drilling can proceed. Large junk, such as a piece of steel pipe may have to be milled down to small pieces in order to be carried to the surface by fluid from the wellbore. These drilled cuttings, formation cavings, debris, junk, milled pieces or similar can be called unwanted solids. Apparently too much of these unwanted solids in a wellbore may reduce the drilling efficiency or hamper the drilling operations. When too much of drilled cuttings are not cleared from the bottom hole and stick to a drill bit causing bit balling, the bit may have to be pulled out of the hole for cleaning or replacing the bit.

Typically, during a conventional wellbore drilling operation and drilling fluid circulation process, drilling fluid is pumped down through a conduit such as hollow drill pipe connected to a drill bit at the far end. The drilling fluid is pumped out of the drill pipe through nozzles on the drill bit and into the annulus formed between the wellbore and the drill pipe. Driven by pump pressure, the fluid discharged out of the drill bit flows upward and carries unwanted solids to the surface. At the surface, the unwanted solids are separated from the drilling fluid by a solids control system, such as a shale shaker, and the clean drilling fluid without the unwanted solids such as cuttings and debris is pumped down the drill pipe again.

Drilling fluid has a certain capacity of carrying the unwanted solids. A higher pump rate for a higher flow rate in a wellbore can be used to improve the carrying capacity. However, the pump rate may be limited by other factors such as maximum working pressure, maximum pump strokes per minute and/or maximum available hydraulic horsepower for a pump. The pump rate may also be limited by the allowed circulation pressure on the wellbore that may fracture the wellbore when the pressure is too high. Increasing fluid viscosity may improve the carrying capacity. However, the viscosity of the drilling fluid also has a limitation. For example, too viscous a fluid can cause excessively high circulation pressure even with a low pump rate.

During completion or recompletion of an oil well, some solids such as gravels or proppants may need to be clean out from the wellbore. When a completed well with gravel pack has been used over years, it may have to be repacked. In this case, the existing gravels in the well, sands, etc. may need to be removed from the well. A well completed by frac pack with proppants may also need to be refraced. In such a case, the proppants in the wellbore have to be removed first. Sometimes the gravels or proppants may be too large and too heavy for regular fluid used to clean the wellbore at a maximum pump rate to carry them out of the wellbore, especially when the wellbore has a long lateral horizontal interval.

During drilling or completion of an oil or gas well, it is often necessary to displace one fluid out of the wellbore or to a different location. When displacing fluid in a wellbore with a different fluid, at the interface, the two fluids tend to commingle and to reduce the displacement efficiency. In some cases, the displacing fluid may bypass the fluid to be displaced causing channeling. It is preferred that the displacing fluid and displaced fluid are least commingled at the interface of the two fluids so that the fluid to be displaced can be efficiently removed. A typical example is displacing drilling mud with cement slurry or cement spacer fluid. Another example is to displace a water based drilling fluid in the wellbore with an oil based drilling fluid. Another example is displacing a drilling fluid with a completion fluid. Another example is to displace a chemical pill to a fracture intercepting a wellbore. In order to maintain the effectiveness of the pill, avoiding commingling with either the fluid ahead of the pill or the displacing fluid behind the pill may be very important.

Others have attempted to improve the carrying capacity of drilling fluid by adding fibers to the drilling fluid. However, fibers that are too short do not have much effect, and fibers that are too long tend to entangle and clog tubing and/or other flow restrictions such as a valve. A concentration of these fibers may improve the carrying capacity of the fluid. Short fibers such as 20 millimeters long may be an optimal length. To increase the carrying capacity, more fibers may be needed. However, too many fibers added to a drilling fluid can make the fluid too viscous such that it no longer behaves as a fluid and tends to clog piping and valves. Properly dispersing fibers into drilling fluid is a very difficult and time consuming process. Another problem with adding fibers to drilling fluid is that when the drilling fluid with fibers dispersed therein is carried to the shale shakers for cuttings separation, the fibers tend to "blind" the screens or plug the meshes causing the shakers to lose their solids separation function.

Due to the limitations of prior art methods, the carrying capacity of a drilling fluid is often not sufficient to transport unwanted solids from a wellbore to the surface. For example, it may be very difficult to clean the wellbore of unwanted solids, drilled cuttings and debris in drilling an extended reach well that has a long horizontal lateral wellbore of approximately 10,000 ft.

Davis, U.S. Pat. Nos. 6,016,872 and 6,164,872 disclose methods for cleaning debris from a wellbore and includes injecting hydrophilic fibers selected from the group consisting of polyolefins, polyesters and nylons, suspended or dispersed in a water based or oil based liquid into the bore and forcing the suspension through the length of the bore, to its open end. In particular, the suspension is directed through sections of the bore holding quantities of debris formed from the drilling operation. The suspension loosens the debris and sweeps substantial quantities of debris from the wellbore.

Palmer et al, U.S. Pat. No. 6,419,019 discloses an improved method for transport of particulate matter in a wellbore fluid, and particularly the transport of particulate matter in subterranean wells, such as hydrocarbon wells, by using translocating fibers and/or platelets fibers to aid in transport of the particulate matter. Additional embodiments include the removal of particulate matter (particles) and particle deposits, such as from drill cuttings, during the drilling of wells, and the removal of particulate matter deposits in cleanout operations.

Wang, U.S. Pat. No. 7,741,247 discloses methods and compositions for sealing fractures, voids, and pores of subterranean rock formations, and sealing off regions of a borehole with one or more openings, such as one or more fractures, voids, and or pores, and around a tubular string with a borehole seal such as a packer or plug. A carrying fluid is utilized to transport a filtration material into the opening to create a bridge, which at least partially seals the opening, but still provides a flow path that permits fluid flow therethrough. A solid material and/or settable material may then utilize the fluid flow subsequently or be simultaneously spotted with or behind the filtration material to thereby form compositions which effectively seals off the flow path into the one or more openings. In one embodiment, the filtration material which provides a plurality of fluid flow paths may comprise a multitude of foam rubber elements having a plurality of cells that permit fluid flow therethrough and define the plurality of fluid flow paths through the filtration material. The multitude of foam rubber elements may be elastic to compress and expand to thereby conform to any subterranean openings.

3. SUMMARY OF THE INVENTION

The present invention overcomes the aforementioned problems and is distinguished over the prior art in general, and these patents in particular by a method and system for sweeping solids or displacing a fluid in a wellbore wherein a plurality of three-dimensional resilient rubber-like flexible reticulated open cell foam elements are dispersed in a drilling, completion or sweep fluid and pumped through tubing or drill pipe and into the annulus between the wellbore and the drill pipe or tubing. In the annulus, the foam elements in its carrying fluid forming a network tend to move as if a unified mass or like a plug. The network impacts and dislodges proppants, gravels, drilled cuttings and other formation debris and carries them efficiently to a different location or to the surface. At the surface, the fluid containing the foam elements and the proppants, gravels, cuttings and debris is carried to a shale shaker where the proppants, gravels, cuttings and debris and the foam elements are separated from the fluid. The separated proppants, gravels, cuttings and debris and the foam elements are collected in a box for disposal and, after new foam elements are added, the completion, drilling or sweep fluid can be recirculated down hole.

One of the significant features and advantages of the present invention is that the flexible foam elements used in the present process may be of any shape such as cubes, triangles, spheres, wedge shapes, diamonds, circles, or shreds, and combinations thereof.

Another significant feature and advantage of this invention is that the size and three-dimensional shape of the flexible foam elements significantly reduces the likelihood of the elements "blinding" shale shaker screens or plugging the meshes and causing the shakers to lose their solids separation function, and the flexible foam elements separated from the fluid at a shale shaker come off the screen very easily due to their size and three-dimensional shape.

Another feature and advantage of this invention is that the reticulated open cell structure of the flexible foam elements allow fluid to saturate the material by flowing into the open cells when mixed with the fluid and the openings in the foam elements are in open communication with the exterior of the foam structure thereby allowing fluid to get into the cells of the foam when contacting the fluid. With the fluid saturation, the foam elements mixed in the completion, drilling or sweep fluid can maximize their networking behavior or influence on the fluid flow and provides large inertia to effectively impact, sweep and move deposited solids such proppants, gravels, drilled cuttings and debris in the wellbore and drive them into a plug like flowing fluid to be carried back to surface.

Another feature and advantage of this invention is that the flexible rubber-like foam elements are of a reticulated open cell structure. This feature allows the drilling or sweep fluid to saturate the cells and allows the pressure inside and outside of the cells to equalize under downhole wellbore pressure whereby the flexible foam elements retain more of their original size and shape downhole for their best effect.

Another feature and advantage of this invention is that the flexible foam elements can form a network in a fluid so that the fluids before and after the network are separated. Furthermore, when the fluids move forward by displacement, at and around the network the fluid tends to move like a solid plug, substantially reducing the fluid commingling tendency.

Another feature and advantage of this invention is that the flexible foam elements are magnetic allowing them to attach one another to form a magnetism enhanced network of the foam elements in a fluid in a wellbore to further enhance the plug flowing effect or carrying or displacing efficiency. These materials may be made from malleable powdered ceramic or ferrite material bonded to synthetic foam rubber or similar materials. These materials may also be made by premixing a magnetic powder to a synthetic material before forming the foam or sponge.

Another feature and advantage of this invention is that the large compressibility and resilient properties of the flexible foam elements allow them to be deformed and compressed in order to pass through flow restrictions in tubing or drill pipe.

Another feature and advantage of this invention is that the resilient or elastic properties of the flexible foam elements allow them to resume their size and shape once they flow through flow restrictions such as bit nozzles. This sudden restoration of their size and shape right out of the bit nozzles is preferred for removing drilled cuttings generated by a drill bit to prevent and/or minimize bit balling.

A further feature and advantage of this invention is that the flexible foam elements have little effects on the circulation pressure during fluid circulation created by interaction of the drilling or sweep fluid and the wellbore wall.

A still further feature and advantage of this invention is that the method and system for removing solids or displacing fluid from a wellbore utilizing a plurality of three-dimensional resilient rubber-like flexible reticulated open cell foam elements dispersed in a completion, drilling or sweep fluid is simple in construction, inexpensive to implement, and rugged and reliable in operation.

Other significant features and advantages objects of the invention will become apparent from time to time throughout the specification and claims as hereinafter related.

4. BRIEF DESCRIPTION OF THE DRAWINGS

The accompanying drawings, which are incorporated in and constitute a part of the specification, illustrate preferred embodiments of the invention. These drawings, together with the general description of the invention given above and the detailed description of the preferred embodiments given below, serve to explain the principles of the invention.

Figure 3:
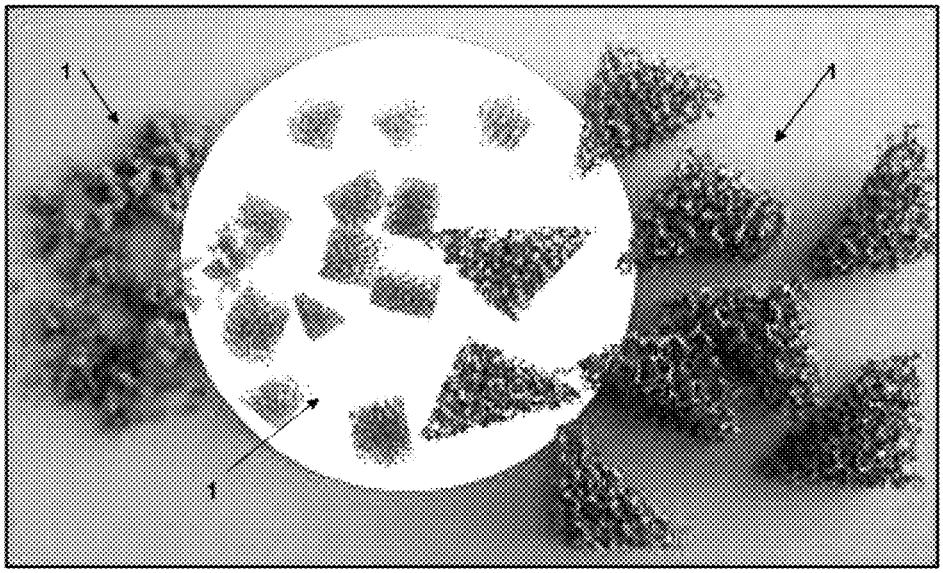

FIG. 3 is another enlarged photograph of the reticulated open cell foam elements in accordance with the present invention where a portion of the foam elements are back lighted to show the open cell form of the foam elements. This construction allows the foam particles to be temporarily compacted when flowing through a constriction such as a drill bit nozzle and readily redeploy into their original size and shape after exiting the constriction. The open cell foam possesses elastic properties allowing compaction and return to the original enlarged shape.

5. DESCRIPTION OF THE PREFERRED EMBODIMENT

Figure 1:
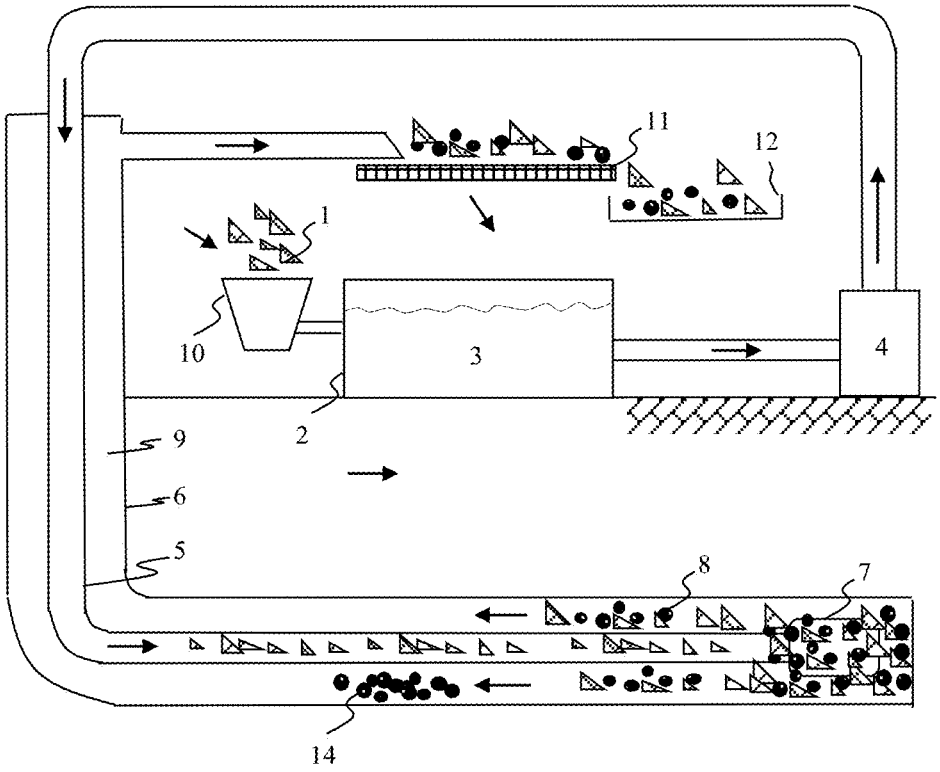
FIG. 1 is a schematic sectional view of an example a wellbore sweeping operation in accordance with the present invention carried out in an exemplary drilling system that is employed to drill substantially horizontal subterranean bores that are oriented parallel to the ground surface.
Figure 2:
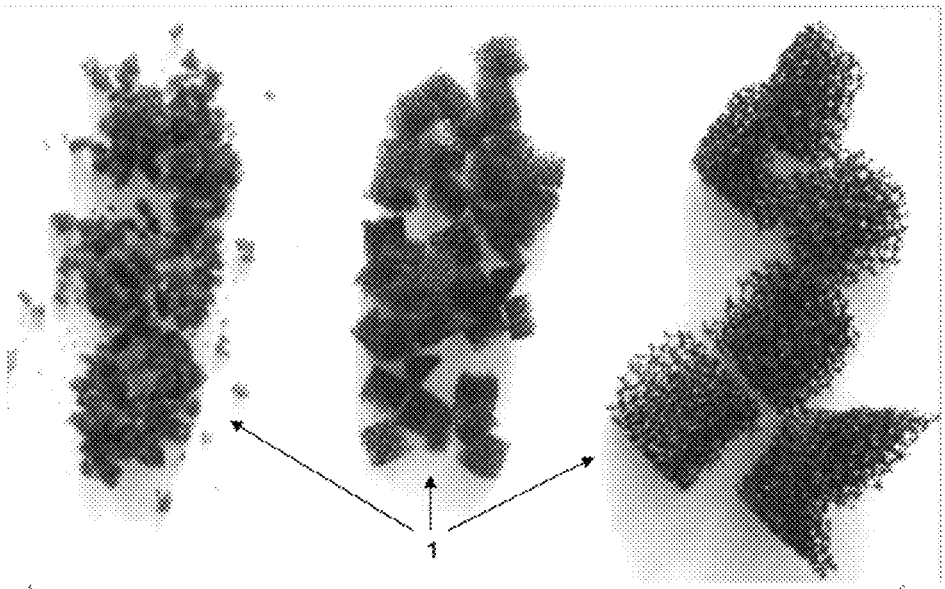
FIG. 2 is an enlarged photograph showing various sizes and shapes of a plurality of the rubber-like flexible reticulated open cell foam elements in accordance with the present invention that may be mixed with the drilling fluid for removing drilled cuttings, formation cavings, and other formation debris from the wellbore and transporting them to the surface.

Referring to the drawings by numerals of reference, there is shown in FIG. 1, a wellbore sweeping operation in accordance with the present invention carried out in a drilling system that is employed to drill horizontal subterranean bores that are oriented substantially parallel to the ground surface. FIGS. 2 and 3 illustrate various sizes and shapes of a plurality of rubber-like flexible reticulated open cell foam elements 1 (described hereinafter) that may be mixed with the drilling fluid for removing drilled cuttings, formation cavings, and other formation debris from the wellbore and transporting them to the surface. It should be understood that the horizontal drilling system is illustrated for purposes of example only, and that the present invention carried out in wellbores that are oriented vertically and at various angles relative to the ground surface.

As shown in FIG. 1, a plurality of resilient rubber-like flexible reticulated open cell foam elements 1 (described hereinafter) are added to the drilling fluid 3 in a tank 2 through a hopper 10. The drilling fluid containing the flexible open cell foam elements 1 is pumped by pump 4 into the drill pipe 5 disposed in a wellbore 6 and travels down through a drill bit 7. The drilling fluid 3 containing the foam elements 1 is pumped out of the drill pipe 5 through nozzles on the drill bit and into the annulus 9 formed between the wellbore and the drill pipe. In the annulus 9, the foam elements 1 impact and dislodge a pile 14 of accumulated drilled cuttings, formation cavings, or other formation debris 8. Driven by pump pressure, the drilled cuttings, formation cavings, or other formation debris 8 are carried by the drilling fluid 3 containing the foam elements 1 through the annulus 9 back to the surface. The carrying capacity of the drilling fluid 3 is enhanced by the foam elements 1. When the concentration of the foam elements in the fluid is high enough, the fluid/foam mixture can move like a concentrated mass or like a plug through the conduit or annulus. At the surface, the drilling fluid 3 containing the foam elements 1 and the cuttings, cavings, or debris 8 is carried to a shale shaker 11 where the cuttings, cavings, or debris 8 and the foam elements 1 are separated from the drilling fluid 3. The separated cuttings, cavings, or debris 8 and the foam elements 1 are collected in a box 12 for disposal. The drilling fluid 3, after new foam elements 1 are added, can then be pumped down hole again.

As seen in FIGS. 2 and 3, the preferred resilient rubber-like flexible reticulated open cell foam elements 1 used in the present process are small pieces of specially designed three-dimensional chunks of rubber-like flexible reticulated foam having an open cell structure and a sponge-like appearance. The flexible foam elements are available in various pore sizes, densities, and shapes. The material suitable for use in making the present open cell flexible foam elements include polyurethane, polyester, polyether, rubber, silicone and other elastic or plastic materials. The flexible foam elements comprise one or more of the following: foam, open cell foam, foam rubber, open cell foam rubber, sponge, and open cell sponge.

The flexible foam elements used in the present process may be of any shape such as cubes, triangles, spheres, wedge shapes, diamonds, circles, or shredded, and combinations thereof.

In a preferred embodiment, the size of the flexible foam elements is in the range of from about 1 mm to about 50 mm in at least one dimension, more preferably ranging from about 2 mm to about 5 mm. Random sizes of the flexible foam elements, preferably not larger than 15 mm maximum in at least one dimension, may be utilized in some drilling fluid applications.

Unlike fibers used in some sweeping operations, the size and three-dimensional shape of the flexible foam element chunks significantly reduces the likelihood of the elements "blinding" the shale shaker screens or plugging the meshes and causing the shakers to lose their solids separation function. The flexible foam elements separated from the drilling fluid at a shale shaker come off the screen very easily due to their size and three-dimensional shape.

Foam materials are classified as having discrete pore sizes measured as pores or cells per inch (PPI) or as a ratio of the number of voids per solid material per linear inch. Materials with a higher PPI value contain less solid material and weigh less. Yet, they maintain a high percentage of the strength and chemical resistance present in the original material. Smaller PPI values mean larger cells and are typically thicker and stronger or stiffer structures. In a preferred embodiment, the flexible foam elements have a PPI value in the range of from about 5 PPI to about 100 PPI, more preferably about 15 PPI to about 50 PPI. The stronger structures of the flexible foam elements have better drilled cuttings removal effects.

The number of PPIs and the size of the pores also determine the permeability of the foam materials. The reticulated open cell structure of the flexible foam elements allow fluid to saturate the material by flowing into the open cells when mixed with the fluid. The pores or openings in the foam elements are at least partially connected to other cells by ligaments, and least some connected pores or openings are in open communication with the exterior of the foam structure. This connectivity allows fluid to get into the cells of the foam when contacting the fluid. Some finger-like ligaments, formed by those surface cells that are cut in half, may extend from the exterior surface of the foam elements. The flexible foam element structure does not entangle like long fibers.

The flexible foam elements are magnetic. The magnetism of the foam elements provide them a mechanism to attach one another to accumulate into a large network. The accumulation or the tendency of forming such accumulation can be offset by turbulence of the carrying fluid of the foam elements. The magnetic flux density of the magnetic foam elements is preferred to be between 0.1 and 100 gauss. The magnetism of the elements is not too large so that the elements can be temporarily dispersed in viscous fluid such as drilling fluid under agitation or similar shearing effects either in a mixing tank or in drillpipe. The magnetism is not too small either so that the elements under a low shearing condition after being pumped out of drillpipe and into the annulus can accumulate to form a large network of the foam elements by the magnetism.

One magnetic foam element sticking with another one by the magnetism has the magnetic abstraction force from both elements. However, one magnetic foam element magnetically sticking to a ferromagnetic wall of steel drillpipe has the magnetic abstraction force from only one magnetic foam element. So the magnetic absorption force from a foam element along the steel wall is approximately only half of the force between two foam elements next to each other inside the network. Furthermore, the moving fluid at the wall has the highest shearing effect. All these tend to make the network of the magnetic foam elements move together and slide along the steel surface of drillpipe or casing, demonstrating a great sweeping or displacing efficiency.

Due to the magnetism, magnetic foam elements are favorable for removing ferromagnetic solids such as casing milling debris or similar steel solids. Ferromagnetic debris can attach to magnetic foam elements and then is carried away together with the foam elements. Due to this effect, relatively larger ferromagnetic debris can also be removed.

The flexible foam elements are easily added from a hopper and dispersed into a tank of fluid agitated by agitators or may be dumped into the drilling fluid from the top of the tank.

A plurality of the three-dimensional flexible foam elements mixed in the fluid maximizes its influence on the fluid flow. The plurality of flexible foam elements saturated with fluid provides large inertia to effectively impact, sweep and move drilled cuttings and debris deposited on the lower side of a horizontal wellbore and drive them into the flowing fluid to be carried back to surface.

On a drillstring, there may be various tools forming fluid flow restrictions. The flexible rubber-like foam elements are highly compressible due to their void cells in the reticulated foam structure. This feature allows them to be highly deformed and compressed at flow restrictions in tubing under flow pressure differentials and allows them to flow through these restrictions easily.

The resilient or elastic features of the flexible foam elements allow them to resume their original shape and size to more effectively remove solids such as proppants, gravels, drilled cuttings and debris once they flow through these restrictions. In a preferred embodiment, the, Young's modulus of the flexible foam elements is greater than approximately 1 kPa, more preferably in a range of from approximately 10 kPa to approximately 100 kPa.

Higher true density of the polymer material used in making the flexible foam elements also provides higher inertia when interacting with drilled cuttings and debris. Preferably, the density of the polymer material used in making the flexible foam elements has a density ranging from about 0.8 g/cm$^3$ to about 2.8 g/cm$^3$, more preferably from about 1.1 g/cm$^3$ to about 1.5 g/cm$^3$.

Circulation pressure created during fluid circulation is a direct interaction of the fluid and the wellbore wall. This is primarily governed by the viscosity of the drilling fluid and the pump rate. Due to the fact that the added flexible foam elements will have little effects on this interaction, the additional circulation pressure incurred by the added flexible foam elements even when a large concentration of the flexible foam elements is added to the fluid.

Higher concentrations of the flexible foam elements can have a better solid removal effect. In a preferred embodiment, the concentration can be from about 0.01 ppb (pound per barrel) to about 10 ppb. Another preferred a concentration is from about 0.3 ppb to about 5 ppb, more preferably from about 0.5 ppb to about 3 ppb, depending upon the particular application.

The greater the volume of drilling fluid containing a plurality of the flexible foam elements, the more effective removal of drilled cuttings and debris is. Preferably the volume is more than about 10 barrels, more preferably the volume is from about 40 barrels to about 200 barrels. It is practical to have the entire drilling fluid system treated using the flexible foam elements. For purpose of this disclosure, one barrel contains 42 gallons.

Higher pump rates can also enhance the removal effects. However, it is preferable to pump the drilling fluid at a normal rate during drilling. A higher than normal pumping rate can also be applied, provided it does not exceed the allowed wellbore pressure. In a preferred embodiment, the pump rate is from approximately 250 gallons per minute to approximately 1630 gallons per minute.

At the interface of two fluids, when one fluid tends to move like a plug, the commingling tendency can be substantially reduced. When the foam elements are used in fluid to reduce the commingling effect at the interface, it is preferred to have the foam elements in at least one fluid. However, when the foam elements are used in fluid to reduce the commingling effect at the interface, the foam elements can be added to the two fluids forming the interface. It will be appreciated that the small size of each foam element combined with finger like ligaments with the large porous structure creates a cohesive mass when mixed with fluid. This effect can be enhanced with fluid of a higher viscosity.

A series of laboratory tests were performed to evaluate the properties of the present flexible foam elements, and their effectiveness in removal of solids. The following are some examples.

Lab Experiment 1

Glass beads of 2.3 g, 1.3 g, 0.65 g, 0.35 g and 0.09 g (all having a density of approximately 2.5 g/cm$^3$) were dropped into a 500 ml beaker containing 350 ml of a 0.5% biopolymer fresh water solution, and all the beads sank to the bottom of the beaker substantially instantaneously.

Lab Experiment 2

A plurality of plurality of a size from 1 to 7 mm three-dimensional flexible foam elements were added into a 500 ml beaker containing 350 ml of a 0.5% biopolymer fresh water solution and mixed with low speed stirring. After the flexible foam wedges were distributed evenly with 10 minutes of stirring, glass beads of 2.3 g, 1.3 g, 0.65 g, 0.35 g and 0.09 g (all having a density of approximately 2.5 g/cm$^3$) were dropped into the beaker and all the beads were suspended in the fluid mixture. The foam elements have formed a network in the fluid that can carry the glass beads easily.

Although for purposes of example, the present flexible foam elements have been described as being mixed with drilling fluid, it should be understood that the fluid for making a sweep fluid mixture containing the flexible foam elements may be any of the following, but not limited thereto: drilling fluid, cementing fluid, workover fluid, fracturing fluid, completion fluid, spacer fluid, sweep fluid, weighted fluid, cement fluid, water, brine, oil, gas, nitrogen, air or combinations of the above.

It should also be understood that other materials, such as fibers and particulates, may be added to the mixture of the drilling or sweeping fluid and flexible foam elements to further enhance the carrying capacity. The fibers may be selected from the group consisting of polyolefins such as polypropylene and polyethylene, nylon, and polyester, and combinations thereof. The fibers may be coated with a hydrophilic surfactant. The particulates may be selected from the group consisting of calcium carbonate, sand, coke, petroleum coke, graphite, resilient graphitic carbon, synthetic graphite, cedar fiber, nut hulls, corn cobs, fiber, synthetic fiber, paper, threaded paper, ground paper, carbon fiber, threaded rug, asphalt, gilsonite, rubber, foam rubber, drilled cuttings, saw dust, mica, wood chips, engineering plastics, hollow spheres, fly ash, hollow plastic spheres, hollow glass spheres, cotton seed hulls, walnut hulls, pistachio hulls, almond hulls, peanut hulls, cement, clay, bentonite, modified clay, organoclay, limestone, dolomite, marble, resin particles, metal particles, ceramic particles, nanotechnology particles, weighting materials such as barite, hematite, iron oxide, ilmenite, and combinations thereof.

This specification is to be construed as illustrative only and is for the purpose of teaching those skilled in the art the manner of carrying out the invention. It is to be understood that the forms of the invention herein shown and described are to be taken as the presently preferred embodiments. As already stated, various changes may be made in the shape, size and arrangement of components or adjustments made in the steps of the method without departing from the scope of this invention. For example, equivalent elements may be substituted for those illustrated and described herein and certain features of the invention maybe utilized independently of the use of other features, all as would be apparent to one skilled in the art after having the benefit of this description of the invention.

While specific embodiments have been illustrated and described, numerous modifications are possible without departing from the spirit of the invention, and the scope of protection is only limited by the scope of the accompanying claims.

The invention claimed is:

1. A method for removing proppants, gravels, drilled cuttings, debris, cavings or other solid materials or displacing a fluid from a wellbore, comprising:

pumping a suspension comprising a plurality of resilient flexible open cell foam elements dispersed in a concentration in a fluid into a conduit positioned in the wellbore, and the conduit defining an annulus between the conduit and the wellbore;

pumping the suspension to a selected opening of the conduit to the annulus and through the annulus to an open end of the wellbore such that the suspension carries at least a portion of the solids material or the fluid to be displaced from the wellbore.

2. The method of claim 1, wherein said resilient flexible open cell foam elements have a reticulated cellular structure with open cells at least partially connected to other cells.

3. The method of claim 1 wherein at least some open cells of the open cell foam elements are in communication with the exterior of the foam structure to allow saturation and fluid flow into internal cavities of the foam structure.

4. The method of claim 1, wherein said resilient flexible open cell foam elements are magnetic.

5. The method of claim 4, wherein said resilient flexible open cell foam elements have a magnetic flux density between 0.1 and 100 gauss.

6. The method of claim 1, comprising forming said resilient flexible open cell foam elements from elastomeric material selected from the group comprising of polyurethane, polyester, polyether, rubber, silicone, plastics or combinations thereof.

7. The method of claim 1, comprising selecting resilient flexible open cell foam elements have a three-dimensional shape from the group comprising of cubes, chunks, triangles, spheres, wedges, diamonds, circles, shredded forms, shreds, and combinations thereof.

8. The method of claim 1, comprising selecting resilient flexible open cell foam elements from a range from approximately 1 mm to approximately 50 mm in at least one dimension.

9. The method of claim 1, comprising selecting resilient flexible open cell foam elements having a PPI (pores per inch) value in a range of from approximately 5 PPI to approximately 100 PPI.

10. The method of claim 1, comprising compressing resilient flexible open cell foam elements to pass through restrictions in fluid flow passageways and thereafter the resilient flexible open cell foam elements resuming their original size and shape.

11. The method of claim 1, comprising said resilient flexible open cell foam elements having a Young's modulus in a range of from approximately 10 kPa to approximately 100 kPa.

12. The method of claim 1, comprising said resilient flexible open cell foam elements having a true density in a range of from approximately 0.8 g/cm$^3$ to approximately 2.8 g/cm$^3$.

13. The method of claim 1, wherein said suspension has a concentration ratio of said resilient flexible open cell foam elements to said fluid having a range of from approximately 0.01 ppb (pounds per barrel) to approximately 10 ppb.

14. The method of claim 1, comprising selecting said fluid from a group consisting of drilling fluid, cementing fluid, workover fluid, fracturing fluid, completion fluid, spacer fluid, sweep fluid, weighted fluid, cement fluid, water, brine, oil, gas, nitrogen, air, and combinations thereof.

15. The method of claim 1, comprising said suspension further having a carrying capacity enhancing additives selected from the group comprising of fibers and particulates or combinations thereof.

16. The method of claim 15, wherein said particulates are selected from the group consisting of calcium carbonate, sand, coke, petroleum coke, graphite, resilient graphitic carbon, synthetic graphite, cedar fiber, nut hulls, corn cobs, fiber, synthetic fiber, paper, threaded paper, ground paper, carbon fiber, threaded rug, asphalt, gilsonite, rubber, foam rubber, drilled cuttings, saw dust, mica, wood chips, engineering plastics, hollow spheres, fly ash, hollow plastic spheres, hollow glass spheres, cotton seed hulls, walnut hulls, pistachio hulls, almond hulls, peanut hulls, cement, clay, bentonite, modified clay, organoclay, limestone, dolomite, marble, resin particles, metal particles, ceramic particles, nanotechnology particles, barite weighting material, hematite weighting material, iron oxide weighting material, ilmenite weighting material, and combinations thereof.

17. The method of claim 1, further comprising separating the foam elements and the carried solids material from the fluid after the suspension reaches the open end of the wellbore.

18. The method of claim 1, comprising said resilient flexible open cell foam elements comprising of one or more of the following: foam, open cell foam, foam rubber, open cell foam rubber, sponge, open cell sponge.

19. Three-dimensional small pieces of rubber-like magnetic flexible reticulated foam elements comprising a resilient flexible open cell structure and a sponge-like appearance and function which when mixed in a fluid the magnetism provides a mechanism to attach one another elements to accumulate into a large network that moves as a plug through a conduit or annulus.

20. Three-dimensional resilient flexible open cell foam elements comprising:

having a true density in a range of from approximately 0.8 $g/cm^3$ to approximately 2.8 $g/cm^3$;

a Young's modulus in a range of from approximately 10 kPa to approximately 100 kPa;

a PPI (pores per inch) value in a range of from approximately 5 PPI to approximately 100 PPI;

said resilient flexible open cell foam elements are magnetic;

selecting said flexible open cell foam elements from a range of approximately 1 mm to approximately 50 mm in at least one dimension; and a reticulated cellular structure with open cells at least partially connected to other cells.

* * * * *